US006450686B1

(12) United States Patent
May

(10) Patent No.: US 6,450,686 B1
(45) Date of Patent: Sep. 17, 2002

(54) RESEALABLE PACKAGE HAVING A REINFORCED SLIDER DEVICE

(75) Inventor: Timothy J. May, Greenville, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 0 days.

(21) Appl. No.: 09/725,974

(22) Filed: Nov. 29, 2000

(51) Int. Cl.[7] ..... B65D 33/16
(52) U.S. Cl. ..... 383/64; 24/416
(58) Field of Search ..... 383/64; 24/399, 24/400, 415, 416

(56) References Cited

U.S. PATENT DOCUMENTS

| | | | | |
|---|---|---|---|---|
| 4,262,395 A | | 4/1981 | Kosky | |
| 5,010,627 A | | 4/1991 | Herrington et al. | |
| 5,283,932 A | | 2/1994 | Richardson et al. | |
| 5,664,299 A | * | 9/1997 | Porchia et al. | 24/399 |
| 5,836,056 A | | 11/1998 | Porchia et al. | |
| 5,867,875 A | * | 2/1999 | Beck et al. | 24/400 |
| 5,896,627 A | * | 4/1999 | Cappel et al. | 24/400 |
| 5,950,285 A | * | 9/1999 | Porchia et al. | 24/390 |
| 6,161,271 A | * | 12/2000 | Schreiter | 29/408 |
| 6,289,561 B1 | * | 9/2001 | Provan et al. | 24/383 |
| 6,293,701 B1 | * | 9/2001 | Tomic | 24/400 |

FOREIGN PATENT DOCUMENTS

| | | |
|---|---|---|
| GB | 1 211 579 | 11/1970 |
| WO | WO 92/17086 | 10/1992 |

* cited by examiner

*Primary Examiner*—Stephen P. Garbe
(74) *Attorney, Agent, or Firm*—Tracy D. Beiriger

(57) ABSTRACT

A resealable, flexible package having a reinforced slider device is disclosed. In one embodiment, the flexible package includes a resealable closure mechanism, such as a recloseable zipper for selective opening and closing of the package. The zipper includes a first and second closure profile. A slider device is operably mounted on the zipper for selectively opening and closing the resealable zipper. The slider device has a top wall and first and second sidewalls depending from the top wall. The slider device includes a reinforcement structure to increase the force required to remove the slider device from the flexible package. In one embodiment, the slider device includes at least one rib member integral with and extending outwardly from the top wall and each of the sidewalls. In another embodiment, the slider device includes a first and second rib member constructed and arranged to reinforce the top wall and each of the sidewalls at separate locations. Accordingly, the rib members increase the rigidity of the slider device, thereby increasing the force required to remove the slider device from the flexible package.

32 Claims, 5 Drawing Sheets

RESEALABLE PACKAGE HAVING A REINFORCED SLIDER DEVICE

FIELD

This disclosure generally relates to closure arrangements for polymer packages, such as, plastic bags. In particular, this disclosure relates to closure arrangements having resealable profiles and slider devices to open and close the profiles.

BACKGROUND

Many packaging applications use resealable containers to store or enclose various types of articles and materials. These packages may be used to store food products, non-food consumer goods, medical supplies, waste materials, and many other articles. Resealable packages are convenient in that they can be closed and resealed after the initial opening to preserve the enclosed contents. The need to locate a storage container for the unused portion of the products in the package is thus avoided. In some instances, providing products in resealable packages appreciably enhances the marketability of those products.

Some types of resealable packages are opened and closed using a slider device. In a typical resealable package, the slider device is operably mounted to a resealable closure mechanism having profiled elements or closure profiles. When the slider device travels in a first direction along the mechanism, the package is selectively closed. When the slider device travels in a second direction along the mechanism, the package is selectively opened. Moreover, the slider device typically includes a system that allows the slider to slide along the resealable closure mechanism without becoming disengaged from the resealable package. However, existing slider devices have shortcomings that limit their usefulness.

For example, many slider devices can be easily removed from the resealable, flexible package by the user with very little effort. However, in many applications, it is typically undesirable for the slider device to be removed from the flexible package. Furthermore, once the slider device is removed from the package, it is typically difficult to replace on the package.

Improvements in the design and manufacture of slider devices are desirable.

SUMMARY OF THE DISCLOSURE

In general terms, this disclosure relates to polymer packages with closure arrangements having resealable closure profiles and slider devices to open and close the profiles. In one aspect, a flexible package is disclosed comprising a package surrounding wall defining an interior and a mouth providing access to the interior. The flexible package also includes a resealable closure mechanism, such as a recloseable zipper, along the mouth for selective opening and closing of the mouth. The zipper also includes a first and second closure profile. A slider device is operably mounted on the zipper for selectively opening and closing the resealable zipper. The slider device has a top wall and a first and second sidewall depending from the top wall. Furthermore, the slider device includes reinforcement structure to increase the force required to remove the slider device from the flexible package. In one embodiment, the slider device includes at least one rib member integral with and extending outwardly from the top wall and each of the sidewalls. The rib member is constructed and arranged to reinforce the top wall and each of the sidewalls.

In yet another aspect, the slider device includes a first and second rib member for reinforcing the top wall and each of the sidewalls. In one aspect, the first rib member is positioned proximate to the first end of the slider device. Similarly, the second rib member is positioned proximate to the second end of said slider device.

The disclosure also concerns a recloseable zipper arrangement. In one embodiment described, the zipper arrangement includes a first closure profile defining a first shoulder and a second closure profile defining a second shoulder. A slider device of the type described above is provided for selectively opening and closing the recloseable zipper arrangement.

Methods of using a resealable package are described. Methods include a step of moving a slider device as described above along a mouth of the package in a first direction to close the package. Furthermore, the method also includes the step of moving the slider device along the mouth of the package in a second direction to open the package.

A method of removing a slider device as described above from the resealable zipper is also disclosed. The method includes the step of flexing the sidewalls apart from each other and against the force of the reinforcing ribs to remove the slider device from the recloseable zipper.

DETAILED DESCRIPTION

Figure 1:
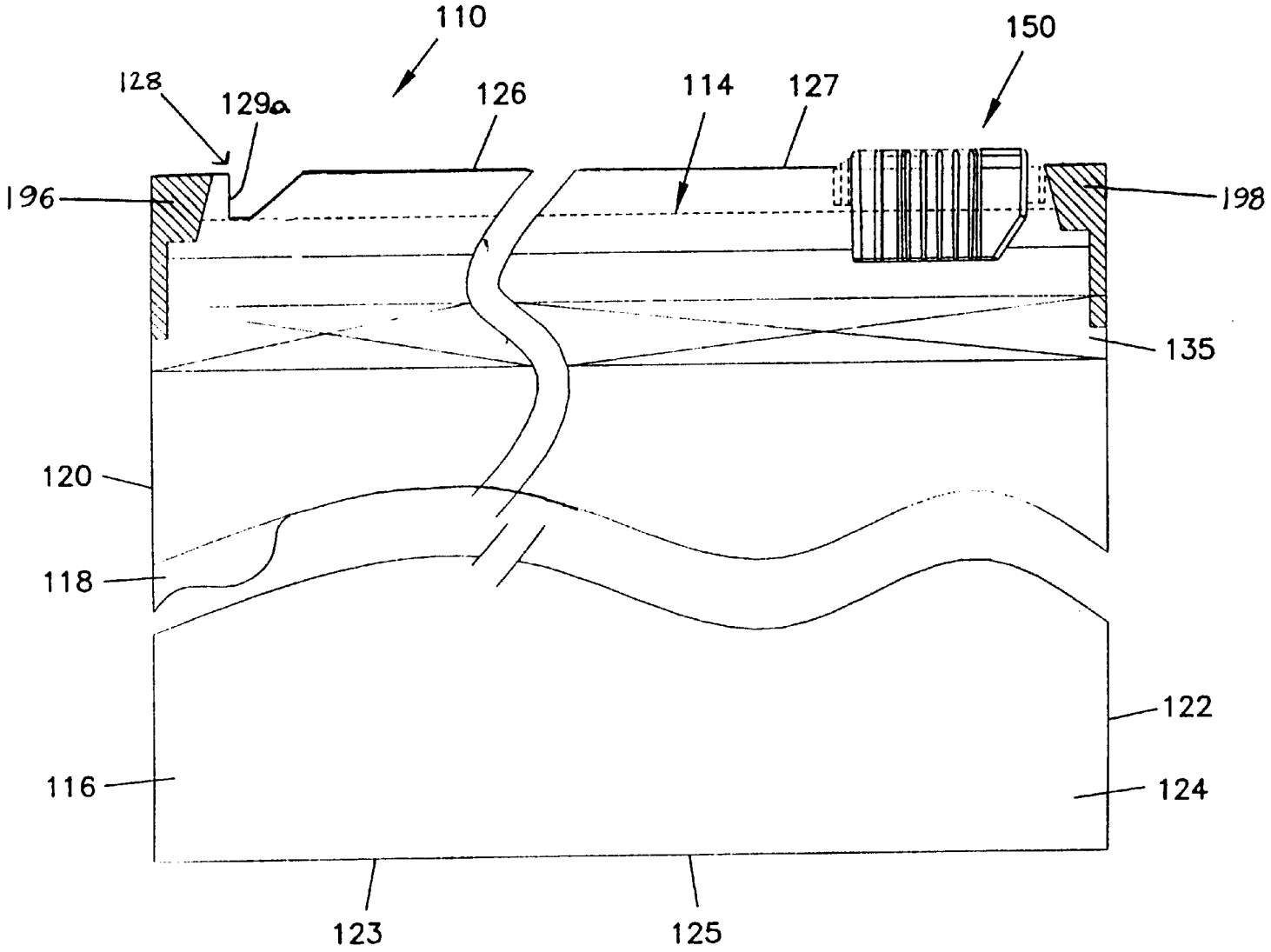
FIG. 1 is a fragmented, side elevational, schematic view of a one possible embodiment of a flexible, resealable package having a slider device, according to principles of this disclosure.

FIG. 1 illustrates one example of a packaging arrangement in the form of a resealable, flexible package 110, for example, a polymeric package such as a plastic bag, having a resealable closure mechanism 114, for example, interlocking profiled elements, constructed in accordance with the principles of this disclosure. The flexible package 110 includes first and second opposed panel sections 116, 118, typically made from a flexible, polymeric, plastic film. With some manufacturing applications, the first and second panel sections 116, 118 are heat-sealed together along two side edges 120, 122 and meet at a fold line 123 in order to form a three-edged containment section for a product within an interior 124 of the package 110. In the embodiment shown, the fold line 123 comprises the bottom edge 125 of the package 110. Alternatively, two separate panel sections 116, 118 of plastic film may be used and heat-sealed together along the two side edges 120, 122 and at the bottom edge 125. Access is provided to the interior 124 of the package 110 through a mouth 126 at a top edge 127 of the package. In the particular embodiment shown, the mouth 126 extends the width of the package 110.

The resealable closure mechanism 114 is illustrated in FIG. 1 at the mouth 126 of the flexible package 110. In the embodiment shown, the resealable closure mechanism 114 extends the width of the mouth 126. Alternatively, the closure mechanism 114 could be positioned on the package 110 at a location different from the mouth 126 of the package 110, depending on the application needs for the package 110.

The resealable closure mechanism 114 can be one of a variety of closure mechanisms. In the particular embodiment illustrated in FIG. 2, the resealable closure mechanism 114 is shown in the specific form of a zipper-type closure mechanism. By the term "zipper-type closure mechanism," it is meant a structure having opposite interlocking or mating profiled elements that under the application of pressure will interlock and close the region between the profiles. Exemplary zipper-type closure mechanisms are disclosed in U.S. Pat. Nos. 4,240,241; 4,246,288; or 4,437,293; each of which is incorporated by reference herein.

Figure 2:
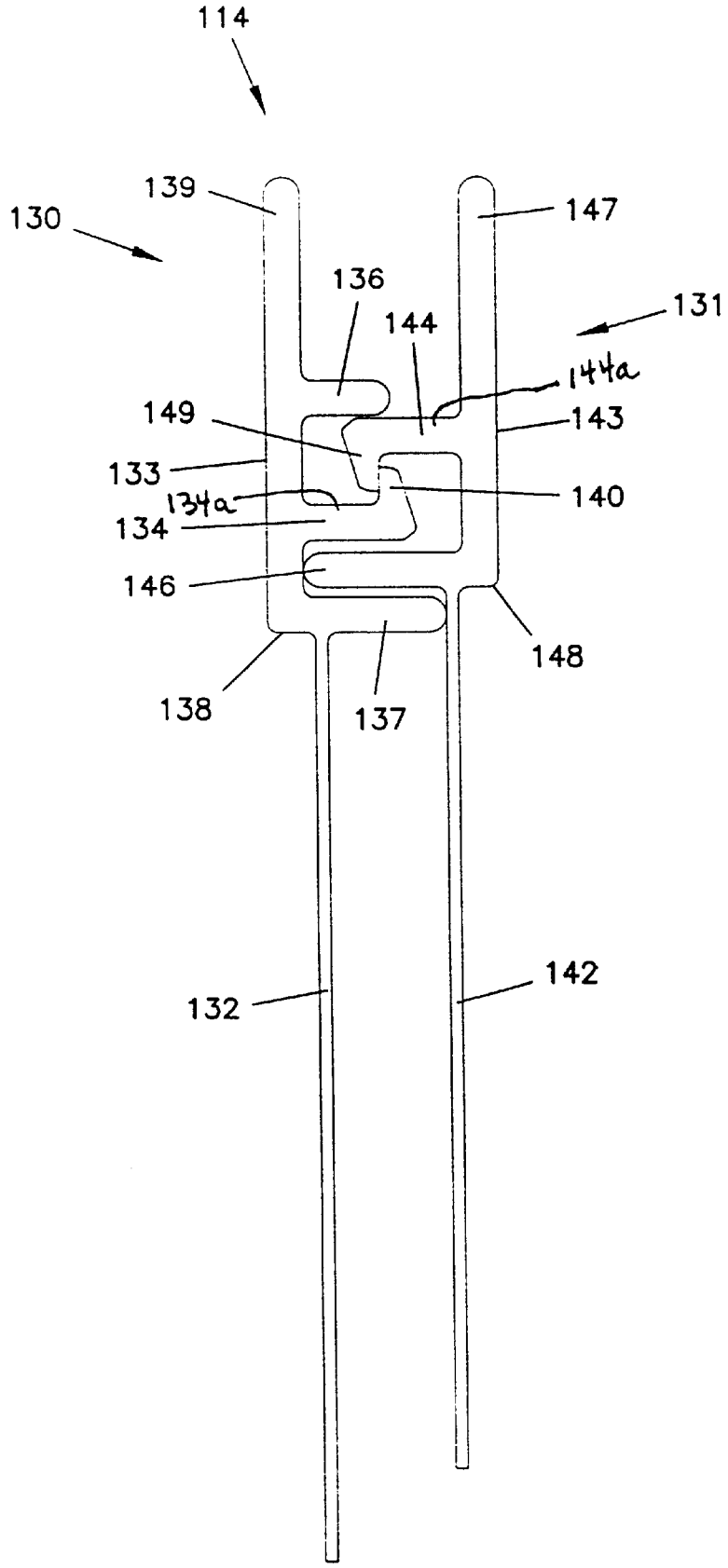
FIG. 2 is a cross-sectional view of one possible embodiment of profiled elements usable with the resealable package of FIG. 1 according to principles of this disclosure.

In particular, the zipper-type closure mechanism in FIG. 2 is an illustration of one example of a closure mechanism 114. The closure mechanism 114 includes an elongated first closure profile 130 and an elongated second closure profile 131. Typically, the closure profiles 130, 131 are manufactured separately from each other.

Still in reference to FIG. 2, the preferred first closure profile 130 depicted includes a sealing flange or bonding strip 132, a base strip 133, a first closure member 134, first and second guide posts 136, 137, and an upper flange 139. The closure member 134 extends from the base strip 133 by way of a stem 134*a* and is generally projecting from the base strip 133. At a free end of the stem 134*a* (the tip of the closure member 134) is a hook or catch 140. The guideposts 136, 137 also extend from the base strip 133 and are generally projecting from the base strip 133. The guide posts 136, 137 aid in holding the closure mechanism 114 closed and in aligning the first closure profile 130 with the second closure profile 131 for interlocking. The bonding strip 132 depends or extends downward from the second guide post 137 and can be attached to a first panel section, such as the first panel section 116 of the package 110 of FIG. 1 at region 135 (FIG. 1). A first shoulder 138 is defined by the intersection of the base strip 133 and bonding strip 132. In the example illustrated, the bonding strip 132 is spaced a distance laterally from the base strip 133 to define a corner forming the shoulder 138. The upper flange 139 extends upwardly from the base strip 133 and first guidepost 136.

The preferred second closure profile 131 depicted includes a bonding strip 142, a base strip 143, a first closure member 144, a guidepost 146, and an upper flange 147. The closure member 144 extends from the base strip 143 by way of a stem 144*a* and is generally projecting from the base strip 143. At a free end of the stem 144*a* (or tip of the closure member 144) is a hook or catch 149. The guidepost 146 also extends from the base strip 143 and is generally projecting from the base strip 143. The guide post 146 aids in holding the closure mechanism 114 closed and aids in aligning the second closure profile 131 with the first closure profile 130 for interlocking. The bonding strip 142 depends or extends downward from the guidepost 146 and can be attached to a second panel section, such as the second panel section 118 of the package 110 of FIG. 1. A shoulder 148, analogous to the shoulder 138, is formed at the corner of the bonding strip 142 and guidepost 146.

The first and second closure profiles 130, 131 are designed to engage with one another to form the resealable closure mechanism 114. The closure member 134 of the first closure profile 130 extends from the base strip 133 a first distance. The closure member 144 of the second closure profile 131 also extends from the base strip 143 a first distance. These first distances that the closure members 134, 144 extend are sufficient to allow mechanical engagement, or interlocking, between the first closure member 134 of the first closure profile 130 and the first closure member 144 of the second closure profile 131. In particular, the catches 140, 149 hook or engage each other. Furthermore, the closure profiles 130, 131 may be sealed together at their ends, such as regions 196, 198 of FIG. 1, to further aid in aligning the closure profiles 130, 131 for interlocking through processes such as ultrasonic crushing. Pressure is applied to the closure profiles 130, 131 as they engage to form the openable sealed closure mechanism 114. Pulling the first closure profile 130 and the second closure profile 131 away from each other causes the two closure profiles 130, 131 to disengage, opening the package 110 of FIG. 1. This provides access to the contents of the package 110 through the mouth 126 (FIG. 1).

In some applications, the closure profiles 130, 131 are formed by two separate extrusions or through two separate openings of a common extrusion. Typically, the resealable closure mechanism 114 is made of conventional materials, such as a polymeric, plastic material, for example, polyethylene or polypropylene. In one example embodiment, the closure arrangement illustrated in FIG. 2 is manufactured using conventional extrusion and heat sealing techniques.

Still referring to FIG. 1, a slider device 150 is provided to open and close the resealable closure mechanism 114. Slider devices and how they function to open and close resealable closure mechanisms, in general, are taught, for example, in U.S. Pat. Nos. 5,063,644; 5,301,394; 5,442,837, and 5,664,229, each of which is incorporated by reference herein.

Figure 3:
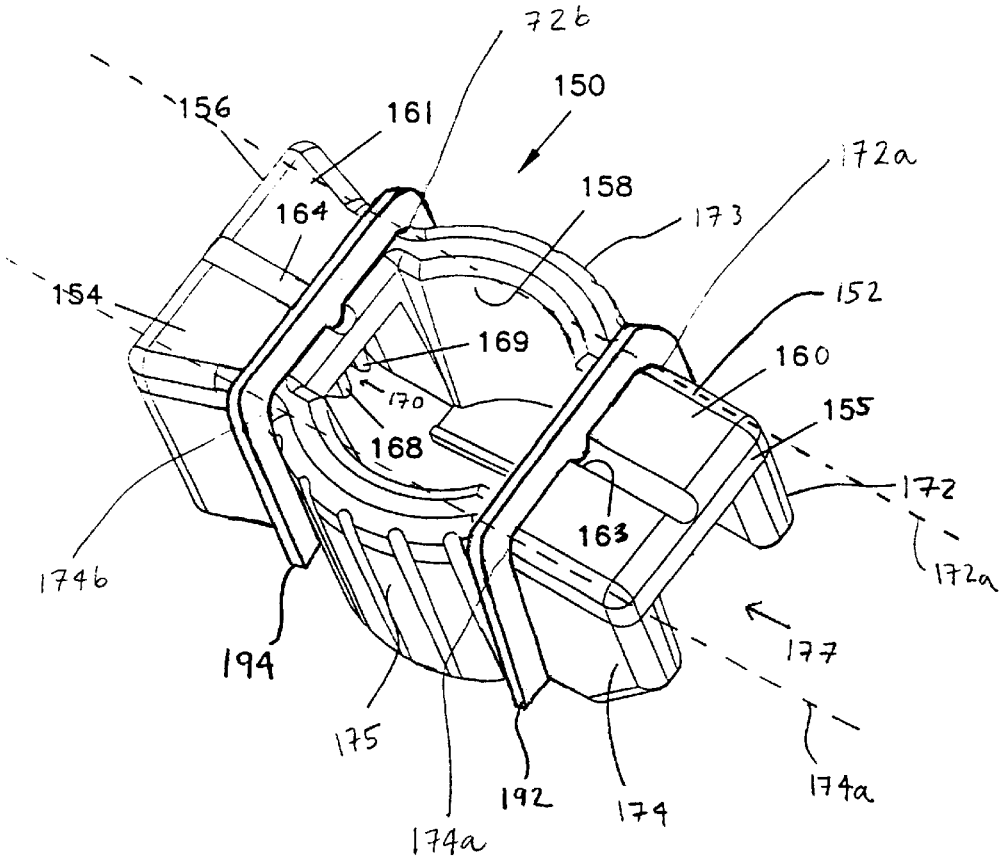
FIG. 3 is an enlarged, top perspective view of the slider device illustrated in FIG. 1.
Figure 4:
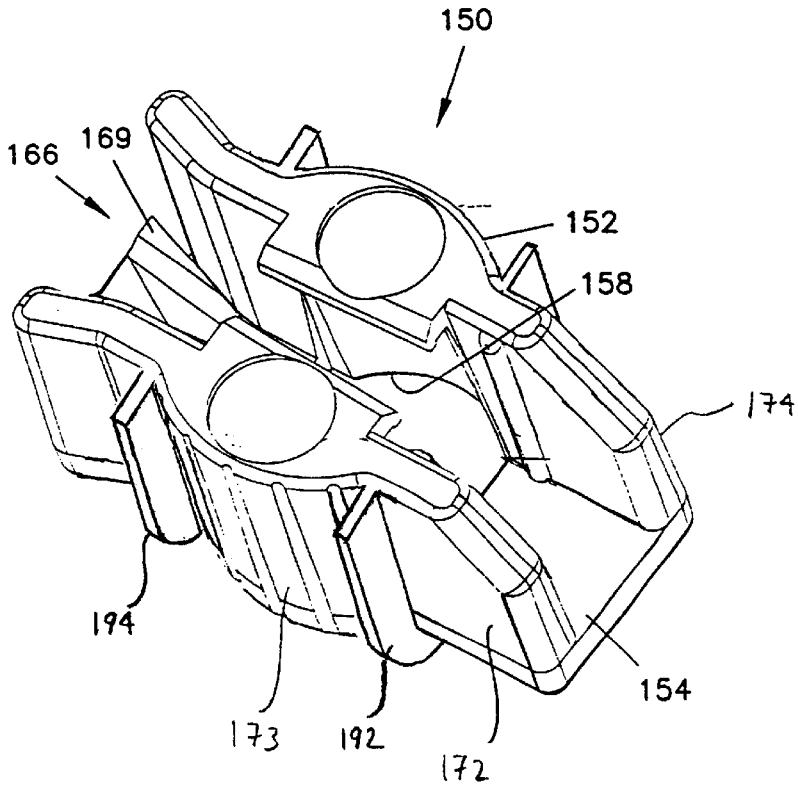
FIG. 4 is an enlarged, bottom perspective view of the slider device illustrated in FIGS. 1 and 3.

An exemplary slider device is shown in FIGS. 3 and 4 in perspective view and preferably comprises a one-piece unitary, molded plastic member with no moveable parts that are moveable with respect to one another. In general, the slider device 150 includes a housing 152 for slidably engaging the closure mechanism 114. The housing 152 is movable between a closed position of the resealable package 110 when the housing 152 is adjacent the side edge 120 and an open position of the resealable package 110 when the housing 152 is adjacent the side edge 122. FIG. 1 illustrates the resealable package 110 in an open position. The housing 152 slides over the resealable closure mechanism 114 relative to the top edge 127 of the resealable package 110 to open and close the mouth 126.

The housing 152 is preferably a multi-sided container configured for engaging or locking onto or over the resealable closure mechanism 114. In the particular embodiment illustrated in FIGS. 3 and 4, the housing 152 includes a top wall 154. By the term "top," it is meant that in the orientation of the slider device 150 shown in FIG. 1, the wall 154 is oriented above the remaining portions of the housing 152. It should be understood, of course, that if the housing 152 is moved from the orientation shown in FIG. 1, the top wall 154 will not be in a top orientation. The top wall 154 defines a first end 155 and an opposite second end 156 of the slider device 150. The top wall 154 also defines an open aperture 158. The open aperture 158 divides the top wall 154 between a first portion 160 and a second portion 161. The first portion 160 generally comprises a flat, planar portion in extension from a periphery of the open aperture 158 to the edge defined by the first end 155. Similarly, the second portion 161 generally comprises a flat, planar portion in extension from a periphery of the open aperture 158 to the edge defined by the second end 156. Each of the first and second portions 160, 161 defines a groove 163, 164 respectively. The aperture 158 and grooves 163, 164 aid in providing a structure that may be more easily injection molded.

The housing 152 includes a separation structure for separating the first and second closure profiles 130, 131. That is, when the resealable closure mechanism 114 is in a closed state such that the closure members 134, 144 are interlocked, the separation structure will apply a force to wedge open and pull the closure members 134, 144 apart from each other. In the embodiment illustrated, the housing 152 includes a spreader 166 operating as a separation structure. The spreader 166, in the preferred embodiment shown, extends or depends from the top wall 154. Preferably, the spreader 166 comprises first and second angled wedges 168, 169 having a gap 170 (FIG. 3) formed therebetween.

In reference again to FIGS. 3 and 4, the preferred housing 152 shown also includes first and second sidewalls 172, 174. Preferably, each of the first and second sidewalls 172, 174 extends from and is cantilevered from the top wall 154 to form a slide channel 177 therebetween. In preferred embodiments, the first and second sidewalls 172, 174 are injection molded with the remaining parts of the housing 152. In other words, preferably the housing 152 comprises a single, unitary, integral piece of material with no additional materials welded, fastened, or bolted together. As can be viewed in FIGS. 3 and 4, the sidewalls 172, 174 can include texturization, such as ribs, 173, 175 to help improve gripping and handling by the user. In FIG. 3, note that the sidewalls 172, 174 are generally parallel in and along the first portion 160; form convex or arcuate portions in a middle section; and diverge away from each other at the second end 156 in and along the second portion 161. These features also facilitate gripping and handling by the user.

Figure 8:
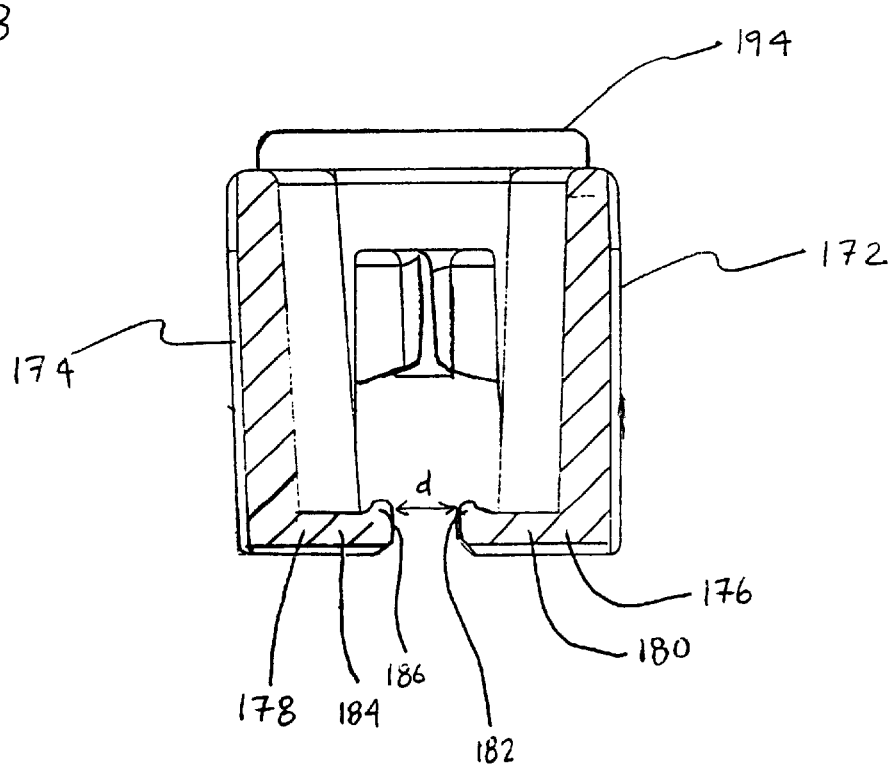
FIG. 8 is an enlarged, cross-sectional view of the slider device illustrated in FIG. 6 taken along line 8—8.

Preferably, the housing 152 includes a system for permitting the housing 152 to slide along the resealable closure mechanism 114 without becoming disengaged from the resealable package 110. In the embodiment illustrated in FIG. 8, the system of the slider housing 152 engages or interlocks with certain structure of the resealable closure mechanism 114. In particular, the housing 152 has a first and a second hook construction 176, 178. The first hook construction 176 preferably extends from the first sidewall 172 in a portion of the housing 152 that is under the open aperture 158 (FIG. 3). As shown in FIG. 8, the first hook construction 176 preferably includes a flange 180 in lateral extension from the first sidewall 172. Extending or projecting from flange 180 is a tip 182 oriented toward the top wall 154 (FIG. 3). As such, the tip 182, in combination with the flange 180, forms a hook or catch for slidable engagement with the shoulder 148 of the second closure profile 131. Similarly, the second hook construction 178 preferably includes a flange 184 in extension from the second sidewall 174 and in a region of the housing 152 below the open aperture 158 (FIG. 3). A tip 186 projects or extends from flange 184 in a direction oriented toward the top wall 154 (FIG. 3). As such, the flange 184 and tip 186 cooperate to form a hook or catch for engaging in a slidable manner with the shoulder 138 of the first closure profile 130.

The slider device 150 is constructed such that it can be removed from the resealable, flexible package 110. For example, the slider device 150 can be removed from the flexible package 110 by forcibly pulling the slider device 150 upwards and away from the resealable closure mechanism 114. In so doing, the first and second sidewalls 172, 174 are flexed away from one another. By "flexed away," it is meant that the first hook construction 176 disengages from the shoulder 148 of the resealable closure mechanism 114 and the second hook construction 178 disengages from the shoulder 138. Typically, the first sidewall 172 flexes about a first axis or line of rotation 172*a* and the second sidewall 174 flexes about a second axis or line of rotation 174*a* (FIG. 3). The first axis 172*a* is generally defined by the intersection of the first sidewall 172 with the top wall 154. Similarly, the second axis 174*a* is generally defined by the intersection of the second sidewall 174 with the top wall 154.

However, as discussed above, it is typically undesirable for the slider device 150 to be removed from the flexible package 110. Accordingly, the slider device 150 of the present disclosure is constructed and arranged to increase the force required to remove the slider device 150 from the resealable, flexible package 110. For example, the slider device 150 includes structure to reinforce the housing 152. By "reinforce," it is meant that the slider device 150 includes structure that increases the rigidity of the top wall 154 and each of the sidewalls 172, 174. Preferably, the slider device 150 includes structure that increases the rigidity of the slider device along the first and second axes 172*a*, 174*a*. While a variety of reinforcement structures are contemplated, in the particular embodiment illustrated in the drawings, the slider device 150 includes at least one rib or stiffening member extending about or across the surface of the top wall 154 and along the sidewalls 172, 174.

Figure 5:
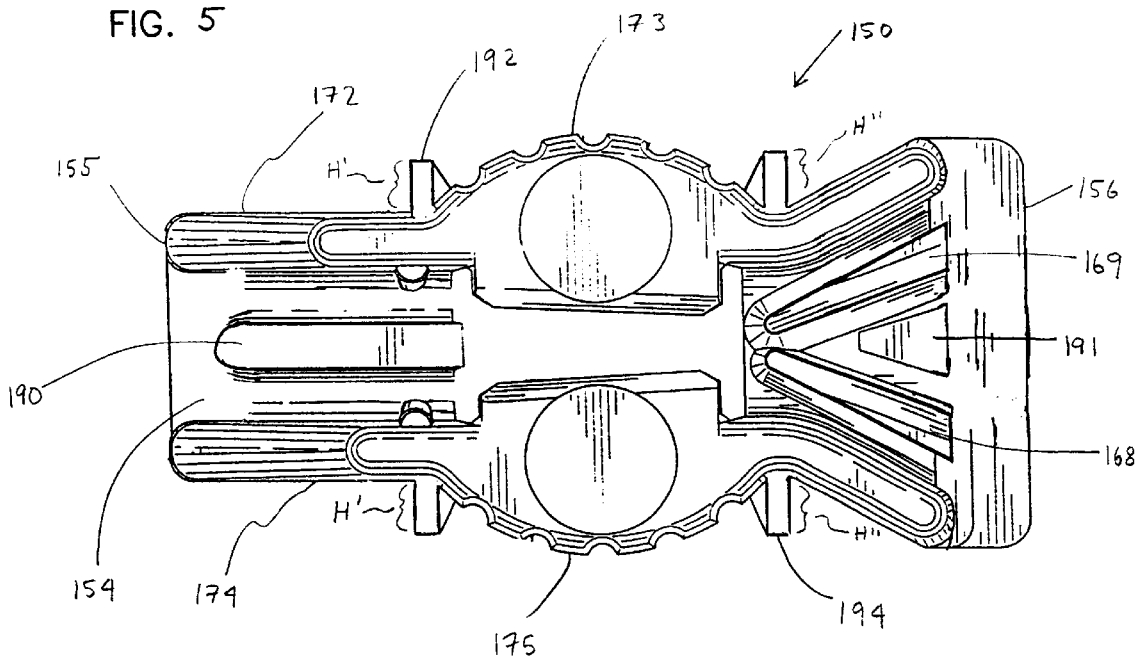
FIG. 5 is an enlarged, bottom plan view of the slider device illustrated in FIGS. 1, 3 and 4.
Figure 6:
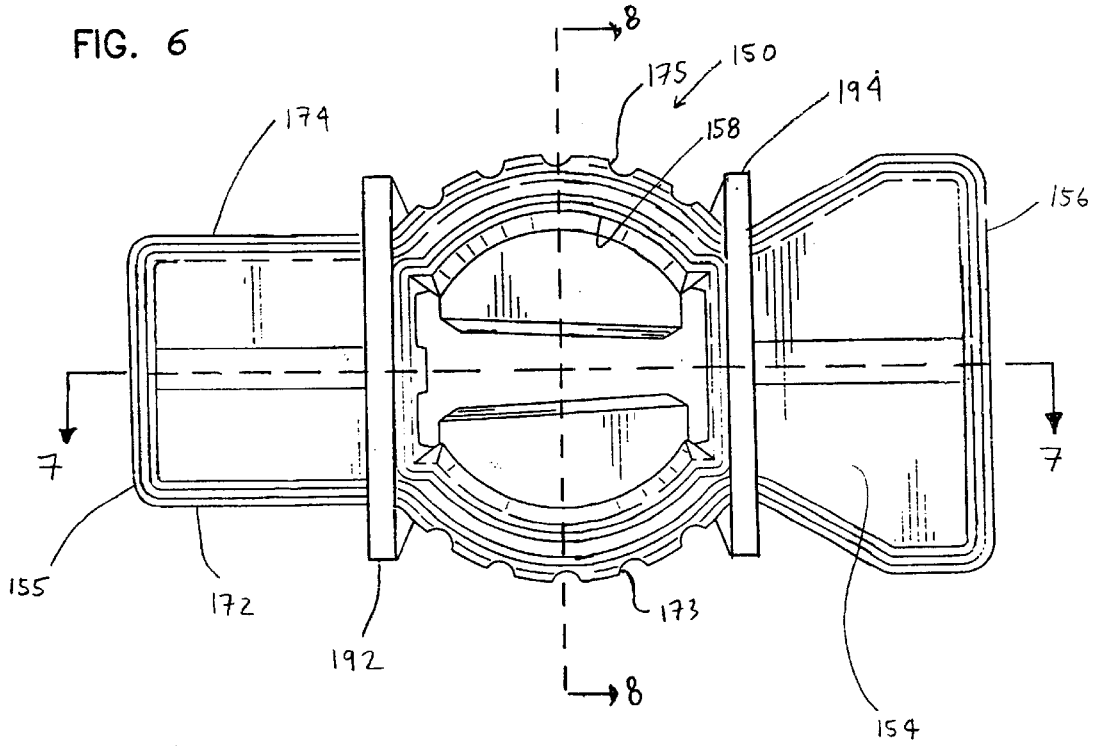
FIG. 6 is an enlarged, top plan view of the slider device illustrated in FIGS. 1, 3, 4, and 5.
Figure 7:
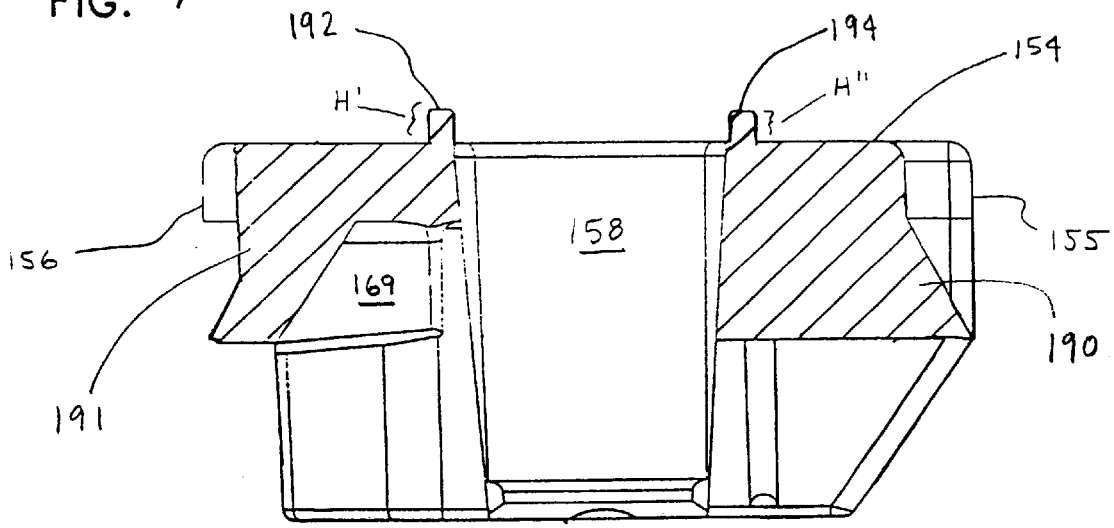
FIG. 7 is an enlarged, cross-sectional view of the slider device illustrated in FIG. 6 taken along line 7—7.

In the embodiment shown in FIGS. 3–8, the slider device 150 includes a first rib member 192 and a second rib member 194. The first rib member 192 is integral with the top wall 154 and each of the sidewalls 172, 174. The first rib member 192 extends substantially outwardly and transversely from the surface of the top wall 154 and each of the sidewalls 172, 174. Moreover, the first rib member 192 extends outwardly from the surface of the top wall 154 and each of the sidewalls 172, 174 a height H' (FIGS. 5 and 6). In one embodiment, the height H' of the first rib member 192 is uniform across the surface of the top wall 154 and each of the sidewalls 172, 174. Alternatively, the height H' varies according to the thickness of the top wall 154 and each of the sidewalls 172, 174. For example, the height H' of the first rib member 192 is substantially equal to about the thickness of the top wall 154 and each of the sidewalls 172, 174, respectively.

Analogously, the slider device 150 also includes a second rib member 194. The second rib member 194 is integral with the top wall 154 and each of the sidewalls 172, 174. The second rib member 194 extends substantially outwardly and transversely from the surface of the top wall 154 and each of the sidewalls 172, 174. Moreover, the second rib member 192 extends outwardly from the surface of the top wall 154 and each of the sidewalls 172, 174 a height H" (FIGS. 5 and 6). In one embodiment, the height H" of the second rib member 194 is uniform across the surface of the top wall 154 and each of the sidewalls 172, 174. Alternatively, the height H" varies according to the thickness of the top wall 154 and each of the sidewalls 172, 174. For example, the height H" of the second rib member 194 is substantially equal to about the thickness of the top wall 154 and each of the sidewalls 172, 174, respectively.

Each of the first and second rib members 192, 194 define a region of greatest cross-sectional wall thickness along the top wall 154 and each of the sidewalls 172, 174. In these regions, the cross-sectional wall thickness is equal to the thickness of the first or second rib members, respectively, and the corresponding wall of slider device 150. As a result, each of the first and second rib members 192, 194 increases the rigidity of the top wall 154 and each of the sidewalls 172, 174, thereby increasing the force required to remove the slider device 150 from the resealable closure mechanism 114.

The first rib member 192 is integral with the top wall 154 and each of the sidewalls 172, 174 and follows the contours of the housing 152. In the embodiment shown in FIGS. 3–8, the first rib member 192 is positioned substantially near the first end 155 of the slider device 150. However, it will be understood that the first rib member 192 can be positioned anywhere along the housing 152 so as to increase the rigidity of the slider device. In one embodiment, the first rib member 192 is positioned from the first end 155 of the slider device 150 at least about 0.08 inches (about 2 mm), no greater than about 0.25 inches (about 6 mm), typically about 0.12–0.20 inches (about 3–5 mm), and in a preferred embodiment about 0.16 inches (about 4 mm).

Similarly, the second rib member 194 is integral with the top wall 154 and each of the sidewalls 172, 174 and follows the contours of the housing 152. In the embodiment shown in FIGS. 3–8, the second rib member 194 is positioned substantially near the second end 156 of the slider device 150. However, it will be understood that the first rib member 192 can be positioned anywhere along the housing 152 so as to increase the rigidity of the slider device. In one embodiment, the second rib member 194 is positioned from the second end 156 of the slider device 150 at least about 0.079 inches (about 2 mm), no greater than about 0.25 inches (about 6 mm), typically about 0.118–0.197 inches (about 3–5 mm), and in a preferred embodiment about 0.157 inches (about 4 mm).

Moreover, the rib members 192, 194 extend outwardly from the top surface 154 and each of the sidewalls 172, 174 and further improve the gripping and handling of the slider device 150 by the user. In one embodiment, the rib members 192, 194 extend outwardly from the top surface 154 and each of the sidewalls 172, 174 at least about 0.02 inches (about 0.5 mm), no greater than about 0.25 inches (about 6 mm), typically about 0.035–0.045 inches (about 0.9–1.1 mm), and in a preferred embodiment about 0.040 inches (about 1.0 mm).

The first and second rib members 192, 194 reinforce the top wall 154 and each of the sidewalls 172, 174. Accordingly, the first and second rib members 192, 194 reduce the tendency of the sidewalls 172, 174 to flex at the axes 172*a*, 174*a*. As a result, the removal force required to remove the slider device 150 from the resealable closure mechanism 114 is significantly increased.

The above specification and examples are believed to provide a complete description of the manufacture and use of particular embodiments of the invention. Many embodiments of the invention can be made without departing from the spirit and scope of the invention.

I claim:

1. A flexible package comprising:

(a) a package surrounding wall defining an interior and a mouth providing access to said interior;

(b) a resealable closure mechanism along said mouth for selective closing and opening of said mouth; said resealable closure mechanism including first and second closure profiles;

(i) said first and second closure profiles being constructed and arranged to interlock; and (c) a slider device operably mounted on said resealable closure mechanism for selectively opening and closing said resealable closure mechanism; said slider device having a first end and a second end opposite said first end; said slider device including:

(i) a top wall;

(ii) a first sidewall depending from said top wall;

(iii) a second sidewall depending from said top wall opposite said first sidewall;

(iv) a first rib member integral with and extending outwardly from said top wall and each of said first and second sidewalls;

(A) said first rib member being positioned proximate to said first end of said slider device;

(1) said first rib member being positioned at least about 0.08 inches from said first end of said slider device;

(v) a second rib member integral with and extending outwardly from said top wall and each of said first and second sidewalls;

(A) said second rib member being positioned proximate to said second end of said slider device; and (1) said second rib member being positioned at least about 0.08 inches from said second end of said slider device.

2. The flexible package according to claim 1, said slider device further including:

(a) said first closure profile includes a first shoulder;

(i) said first sidewall defining a first hook construction to slidably cover said first shoulder of said first closure profile; and (b) said second closure profile includes a second shoulder;

(i) said second sidewall defining a second hook construction to slidably cover said second shoulder of said second closure profile.

3. The flexible package according to claim 1, wherein:

(a) said first rib member is positioned no greater than about 0.25 inches from said first end of said slider device; and (b) said second rib member is positioned no greater than about 0.25 inches from said second end of said slider device.

4. The flexible package according to claim 1, wherein:

(a) said first sidewall defines a first arcuate surface between said first and second rib members extending outwardly from said first side wall; and (b) said second sidewall defines a second arcuate surface between said first and second rib members extending outwardly from said second sidewall.

5. The flexible package according to claim 1, wherein:

(a) said first and second rib members extend at least about 0.05 inches from said top wall and each of said sidewalls.

6. A recloseable zipper arrangement, comprising:

(a) a first closure profile;

(b) a second closure profile;

(i) said first and second closure profiles being constructed and arranged to interlock; and (c) a slider device operably mounted on said recloseable zipper arrangement for selectively opening and closing said recloseable zipper arrangement; said slider device having a first end and a second end opposite said first end; said slider device including:

(i) a top wall;
(ii) a first sidewall depending from said top wall;
(iii) a second sidewall depending from said top wall opposite said first sidewall;
(iv) a first rib member integral with and extending outwardly from said top wall and each of said first and second sidewalls;
(A) said first rib member being positioned proximate to said first end of said slider device;
(1) said first rib member being positioned at least about 0.08 inches from said first end of said slider device;
(v) a second rib member integral with and extending outwardly from said top wall and each of said first and second sidewalls;
(A) said second rib member being positioned proximate to said second end of said slider device; and
(1) said second rib member being positioned at least about 0.08 inches from said second end of said slider device.

7. The recloseable zipper arrangement according to claim 6, wherein:
(a) said first closure profile includes a first shoulder;
(i) said first sidewall defining a first hook construction to slidably cover said first shoulder of said first closure profile; and
(b) said second closure profile includes a second shoulder;
(i) said second sidewall defining a second hook construction to slidably cover said second shoulder of said second closure profile.

8. The recloseable zipper arrangement according to claim 6, wherein:
(a) said first rib member is positioned at least about 0.08 inches from said first end of said slider device; and
(b) said second rib member is positioned at least about 0.08 inches from said second end of said slider device.

9. The recloseable zipper arrangement according to claim 6, wherein:
(a) said first rib member is positioned no greater than about 0.25 inches from said first end of said slider device; and
(b) said second rib member is positioned no greater than about 0.25 inches from said second end of said slider device.

10. The recloseable zipper arrangement according to claim 6, wherein:
(a) said first sidewall defines a first arcuate surface between said first and second rib members extending outwardly from said first side wall; and
(b) said second sidewall defines a second arcuate surface between said first and second rib members extending outwardly from said second sidewall.

11. The recloseable zipper arrangement according to claim 6, wherein:
(a) said first and second rib members extend at least about 0.05 inches from said top wall and each of said sidewalls.

12. A slider device for use with a resealable package having interlocking closure members; the slider device comprising:
(a) a top wall;
(b) a first sidewall depending from said top wall;
(c) a second sidewall depending from said top wall opposite said first sidewall; and
(d) a first rib member integral with and extending outwardly from said top wall and each of said first and second sidewalls;
(i) said first rib member being constructed and arranged to reinforce said top wall and each of said first and second sidewalls;
(ii) said first rib member being positioned proximate to a first end of said slider device;
(iii) said top wall and each of said sidewalls having a region of greatest cross-sectional wall thickness at said first rib member;
(iv) said first rib member being positioned at least about 0.08 inches from said first end of said slider device; and
(e) a second rib member integral with and extending outwardly from said top wall and each of said first and second sidewalls;
(i) said second rib member being constructed and arranged to reinforce said top wall and each of said first and second sidewalls;
(ii) said second rib member being positioned proximate to a second end of said slider device;
(iii) said top wall and each of said sidewalls having a region of greatest cross-sectional wall thickness at said second rib member; and
(iv) said second rib member being positioned at least about 0.08 inches from said second end of said slider device.

13. The slider device according to claim 12, wherein:
(a) said first rib member is positioned no greater than about 0.25 inches from said first end of said slider device; and
(b) said second rib member is positioned no greater than about 0.25 inches from said second end of said slider device.

14. The slider device according to claim 12, wherein:
(a) said first sidewall defines a first arcuate surface between said first and second rib members extending outwardly from said first side wall; and
(b) said second sidewall defines a second arcuate surface between said first and second rib members extending outwardly from said second sidewall.

15. The slider device according to claim 12, wherein:
(a) said first and second rib members extend at least about 0.05 inches from said top wall and each of said sidewalls.

16. A method of using a resealable package comprising steps of:
(a) providing a package having a resealable mouth and resealable zipper arrangement with a slider device thereover for closing and opening the mouth; the slider device having a first end and a second end opposite the first end; the slider device comprising:
(i) a top wall;
(ii) a first sidewall depending from the top wall;
(iii) a second sidewall depending from the top wall opposite the first sidewall; and
(iv) first and second rib members integral with and extending outwardly from the top wall and each of said first and second sidewalls;
(A) the first and second rib members being constructed and arranged to reinforce the top wall and each of the first and second sidewalls;
(B) the first rib member being positioned at least about 0.08 inches from the first end of the slider device;
(C) the second rib member being positioned at least about 0.08 inches from the second end of the slider device; and (b) moving the slider device along the resealable closure mechanism in a first direction to close the resealable closure mechanism.

17. The method according to claim 16, wherein said method further including a step of:

(a) moving the slider device along the mouth a second direction to open the resealable closure mechanism.

18. A flexible package comprising:

(a) a package surrounding wall defining an interior and a mouth providing access to said interior;

(b) a resealable closure mechanism along said mouth for selective closing and opening of said mouth; said resealable closure mechanism including first and second closure profiles;

(i) said first and second closure profiles being constructed and arranged to interlock; and (c) a slider device operably mounted on said resealable closure mechanism for selectively opening and closing said resealable closure mechanism said slider device having a first end and a second end opposite said first end; said slider device including:

(i) a top wall;

(ii) a first sidewall depending from said top wall;

(iii) a second sidewall depending from said top wall opposite said first sidewall;

(iv) a first rib member integral with and extending outwardly from said top wall and each of said first and second sidewalls;

(A) said first rib member being positioned proximate to said first end of said slider device;

(v) a second rib member integral with and extending outwardly from said top wall and each of said first and second sidewalls;

(A) said second rib member being positioned proximate to said second end of said slider device;

(vi) said first sidewall defining a first arcuate surface between said first and second rib members extending outwardly from said first side wall; and (vii) said second sidewall defining a second arcuate surface between said first and second rib members extending outwardly from said second sidewall.

19. The flexible package according to claim 18, said slider device further including:

(a) said first closure profile includes a first shoulder;

(i) said first sidewall defining a first hook construction to slidably cover said first shoulder of said first closure profile; and (b) said second closure profile includes a second shoulder;

(i) said second sidewall defining a second hook construction to slidably cover said second shoulder of said second closure profile.

20. The flexible package according to claim 18, wherein:

(a) said first rib member is positioned no greater than about 0.25 inches from said first end of said slider device; and (b) said second rib member is positioned no greater than about 0.25 inches from said second end of said slider device.

21. The flexible package according to claim 20 wherein:

(a) said first rib member is positioned at least about 0.08 inches from said first end of said slider device; and (b) said second rib member is positioned at least about 0.08 inches from said second end of said slider device.

22. The flexible package according to claim 18, wherein:

(a) said first and second rib members extend at least about 0.05 inches from said top wall and each of said sidewalls.

23. A recloseable zipper arrangement, comprising:

(a) a first closure profile;

(b) a second closure profile;

(i) said first and second closure profiles being constructed and arranged to interlock; and (c) a slider device operably mounted on said recloseable zipper arrangement for selectively opening and closing said recloseable zipper arrangement; said slider device having a first end and a second end opposite said first end; said slider device including:

(i) a top wall;

(ii) a first sidewall depending from said top wall;

(iii) a second sidewall depending from said top wall opposite said first sidewall;

(iv) a first rib member integral with and extending outwardly from said top wall and each of said first and second sidewalls;

(A) said first rib member being positioned proximate to said first end of said slider device;

(v) a second rib member integral with and extending outwardly from said top wall and each of said first and second sidewalls;

(A) said second rib member being positioned proximate to said second end of said slider device;

(vi) said first sidewall defining a first arcuate surface between said first and second rib members extending outwardly from said first side wall; and (vii) said second sidewall defining a second arcuate surface between said first and second rib members extending outwardly from said second sidewall.

24. The recloseable zipper arrangement according to claim 23 wherein:

(a) said first closure profile includes a first shoulder;

(i) said first sidewall defining a first hook construction to slidably cover said first shoulder of said first closure profile; and (b) said second closure profile includes a second shoulder;

(i) said second sidewall defining a second hook construction to slidably cover said second shoulder of said second closure profile.

25. The recloseable zipper arrangement according to claim 24, wherein:

(a) said first rib member is positioned at least about 0.08 inches from said first end of said slider device; and (b) said second rib member is positioned at least about 0.08 inches from said second end of said slider device.

26. The recloseable zipper arrangement according to claim 25, wherein:

(a) said first rib member is positioned no greater than about 0.25 inches from said first end of said slider device; and (b) said second rib member is positioned no greater than about 0.25 inches from said second end of said slider device.

27. The recloseable zipper arrangement according to claim 26, wherein:

(a) said first and second rib members extend at least about 0.05 inches from said top wall and each of said sidewalls.

28. A slider device for use with a resealable package having interlocking closure members; the slider device comprising:

(a) a top wall;

(b) a first sidewall depending from said top wall;

(c) a second sidewall depending from said top wall opposite said first sidewall; and (d) a first rib member integral with and extending outwardly from said top wall and each of said first and second sidewalls;

(i) said first rib member being constructed and arranged to reinforce said top wall and each of said first and second sidewalls;

(ii) said first rib member being positioned proximate to a first end of said slider device;

(iii) said top wall and each of said sidewalls having a region of greatest cross-sectional wall thickness at said first rib member;

(e) a second rib member integral with and extending outwardly from said top wall and each of said first and second sidewalls;

(i) said second rib member being constructed and arranged to reinforce said top wall and each of said first and second sidewalls;

(ii) said second rib member being positioned proximate to a second end of said slider device; and (iii) said top wall and each of said sidewalls having a region of greatest cross-sectional wall thickness at said second rib member;

(f) said first sidewall defining a first arcuate surface between said first and second rib members extending outwardly from said first side wall; and (g) said second sidewall defining a second arcuate surface between said first and second rib members extending outwardly from said second sidewall.

29. The slider device according to claim 28, wherein:

(a) said first rib member is positioned no greater than about 0.25 inches from said first end of said slider device; and (b) said second rib member is positioned no greater than about 0.25 inches from said second end of said slider device.

30. The slider device according to claim 28, wherein:

(a) said first and second rib members extend at least about 0.05 inches from said top wall and each of said sidewalls.

31. The slider device according to claim 30, wherein:

(a) said first rib member is positioned at least about 0.08 inches from said first end of said slider device; and (b) said second rib member is positioned at least about 0.08 inches from said second end of said slider device.

32. A method of removing a slider device from a resealable zipper; the method comprising:

(a) providing a slider device operably oriented on the resealable zipper; the slider device comprising:

(i) a top wall; and (ii) a first sidewall depending from the top wall;

(iii) a second sidewall depending from the top wall opposite the first sidewall;

(A) the top wall and each of the sidewalls having a first and second rib member integral with and extending outwardly therefrom; each of the first and second rib members being constructed and arranged to reinforce the top wall and each of the first and second sidewalls;

(iv) a first arcuate surface between the first and second rib members; the first arcuate surface constructed and arranged to reinforce the first sidewall;

(v) a second arcuate surface between the first and second rib members; the second arcuate surface constructed and arranged to reinforce the second sidewall;

(b) flexing the sidewalls apart from each other and against a force of the reinforcing ribs to remove the slider device from the recloseable zipper.

* * * * *